US006086434A

United States Patent [19]

Rollero et al.

[11] Patent Number: 6,086,434

[45] Date of Patent: Jul. 11, 2000

[54] ONE PIECE TERMINAL SYSTEM

[75] Inventors: Marco Rollero; Mario Aimasso, both of Turin, Italy; Robert Leroy Sten, Warren, Ohio

[73] Assignee: General Motors Corporation, Detroit, Mich.

[21] Appl. No.: 09/027,524

[22] Filed: Feb. 23, 1998

[51] Int. Cl.[7] ..... H01R 11/22

[52] U.S. Cl. ..... 439/852; 439/842

[58] Field of Search ..... 439/843, 842, 439/844, 849, 850, 851, 852, 853, 861

[56] References Cited

U.S. PATENT DOCUMENTS 5,599,212 2/1997 Sawada ..... 439/852

OTHER PUBLICATIONS

R. Mroczkowski. Electronic Connector Textbook, McGraw–Hill, 1998.

*Primary Examiner*—Gary F. Paumen
*Assistant Examiner*—Alexander Gilman
*Attorney, Agent, or Firm*—Patrick M. Griffin

[57] ABSTRACT

An electrical connector system including an electrical female terminal an electrical contact portion for making electrical contact with either a round or square type male pin with chamfered corners. The contact portion including first, second and third finger each having a first end connected to a bridge and the second finger having a first end connected an outer barrel portion, and the first and third fingers having free ends. The electrical contact portion is received in and enclosed by the outer barrel portion and so that the other barrel portion has an open end to allow a male pin to be inserted therein and to make electrical contact with the first, second and third fingers. The terminal is a one piece tangless female terminal.

6 Claims, 3 Drawing Sheets

ONE PIECE TERMINAL SYSTEM

FIELD OF THE INVENTION

This invention relates to electrical connection systems, and more particularly to an electrical connection system utilizing a female electrical terminal capable of receiving either a round or a square type male pin.

BACKGROUND OF THE INVENTION

The electronic industry is utilizing a 0.64 mm square pin as a standard for signal connection. This square pin is normally used in conjunction with 2.54 mm center line cavity to cavity and row to row connector housing assemblies. A non-oriented female terminal made for such a square pin doesn't have a consistent deflection in the beams producing the contact in the female terminal. This means that if the elastic member used for making electrical contact in the female terminal is dimensions to have good contact forces at the minimum deflection configuration, the elastic member will likely be over stressed at the point of maximum deflection. On the other side, if the elastic member is dimension to have good contact force at maximum deflection, the elastic member probably won't have enough contact force at the minimum deflection configuration.

The present invention provides alternatives to and advantages over the prior art.

SUMMARY OF THE INVENTION

An electrical connector system including an electrical female terminal an electrical contact portion for making electrical contact with either a round or square type male pin with chamfered corners. The contact portion including first, second and third finger each having a first end connected to a bridge and the second finger having a first end connected an outer barrel portion, and the first and third fingers having free ends. The electrical contact portion is received in and enclosed by the outer barrel portion and so that the other barrel portion has an open end to allow a male pin to be inserted therein and to make electrical contact with the first, second and third fingers. The terminal is a one piece tangless female terminal.

These and other, objects, features and advantages will be apparent from the following brief description of the drawings, detailed description and appended claims and drawings.

DETAILED DESCRIPTION

Figure 1:
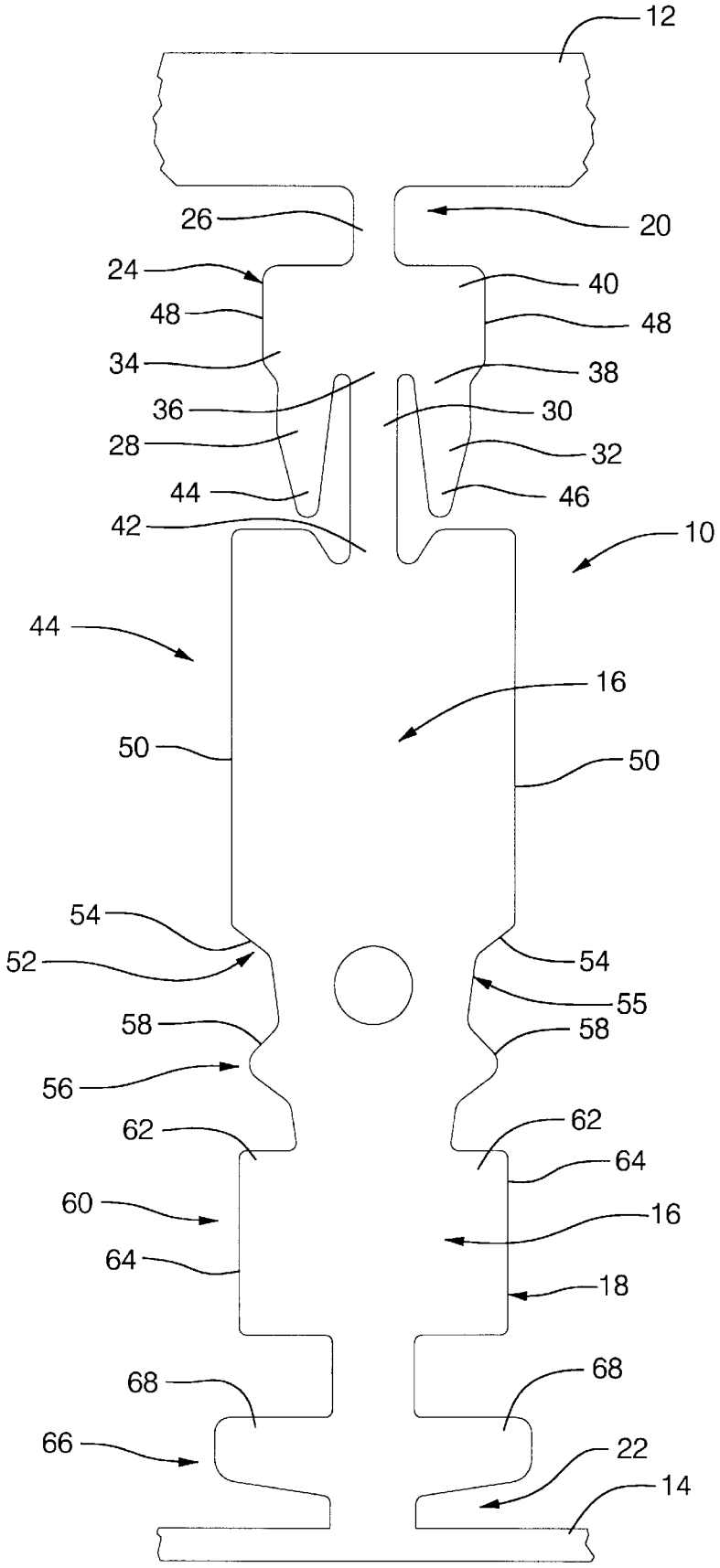
FIG. 1 illustrates a stamped metal blank for making an electrical female terminal according to the present invention.

FIG. 1 illustrates a stamped metal blank 10 used to make a female electrical terminal capable of receiving both round and square like male terminal pins. The blank 10 will now be described with reference to a top surface 16 visible from FIG. 1 in opposite bottom surface 18 not visible from FIG. 1 and with respect to be top 20 of the blank closest to the first carrier strip 12th and the bottom 22 of the blank closest to the second carrier strip 14. The blank 10 is attached at a top 20 to a first carrier strip 12 and at the bottom 22 and to a second carrier strip 14 for easy automated processing. A first section 24 of the blank is connected to be first carrier strip 12 by a lead 26. The first section 24 will be utilized to make any electrical contact portion of the female terminal that directly engages the male pin. The first section 24 includes first, second and third electrical contact fingers 28, 30 and 32 respectively. Each electrical contact finger has a first end 34, 36 and 38 respectively connected to a bridge 40. The bridge 40 includes two oppositely position outer side edges 48. The second finger 30 has a second end 42 connected to a second section 44 of the blank. The first and third electrical contact fingers 28 and 32 each included a free second end 44 and 46 respectively. The first and second electrical contact fingers 28 and 32 are positioned on opposite sides of the second contact finger 30.

The second section 44 of the blank is utilized to make an outer barrel of the female terminal which will enclose the first section 24 as will be described hereafter. The second section 44 has a generally rectangular shape and includes two oppositely positioned side edges 50. And as described earlier the second section 44 also includes a top surface 16.

A third section 52 is attached at the lower in the second section and includes side edges 54 that are tapered inward towards the center line of the blank. The third section 52 will be utilized to make a necked down section of the outer surface of the female terminal which may be used as a locking shoulder for engagement with a flexible lock finger of a female terminal retainer of the connector housing as will be described hereafter.

A fourth section 56 may be attached to be third section and may include outer edges 58 which are tapered outward away from the center line of the blank. This fourth section may be utilized to provide a raised feature on the outer surface of the female terminal adjacent the necked down section associated with the tapered portion of the fourth section 56 for engagement with a lock nub on a flexible finger of a female terminal retainer.

A fifth section 60 may be attached to the fourth section 56 and may have a generally rectangular configuration with outwardly extending crimp tabs 62 for crimping on to the wire portion of a cable. The fifth section 60 also includes two oppositely positioned side edges 64.

A sixth section 66 may be attached to the fifth section 60 and includes to outwardly extending insulation crimp wings 68.

Once the above described blank is provided, a female electrical terminal according to the present invention is formed by bending the first section 24 of the blank so that these side edges 48 of the bridge 40 are moved away from the top surface of the blank to converge on each other and so that the first, second and third electrical contact fingers are positioned at approximately 60 degrees to each other. Preferably the first section 24 is formed using an anvil that produces an arcuate configuration of the first, second and third electrical contact fingers 28, 30 and 32 respectfully. The lead 26 is then cut.

Thereafter, the second electrical contact finger 30 is bent to overlying the top surface 16 of the second section 44. Then, the second section 44 is bent to so that the side edges

50 converge on each other to form in outer barrel enclosing the first section 24 and the first, second and third electrical contact fingers 28, 30 and 32 respectively. At the same time, the third section 52 and the fourth section 56 are bent so that the tapered sides 54 converge on each other and so that the outer edges 58 converge on other.

If desired, thereafter the crimped tabs 62 of the fifth section 60 and the crimp wings 68 may be bent upward in position to receive the wire portion and insulation portion of a cable respectively.

Figure 2:
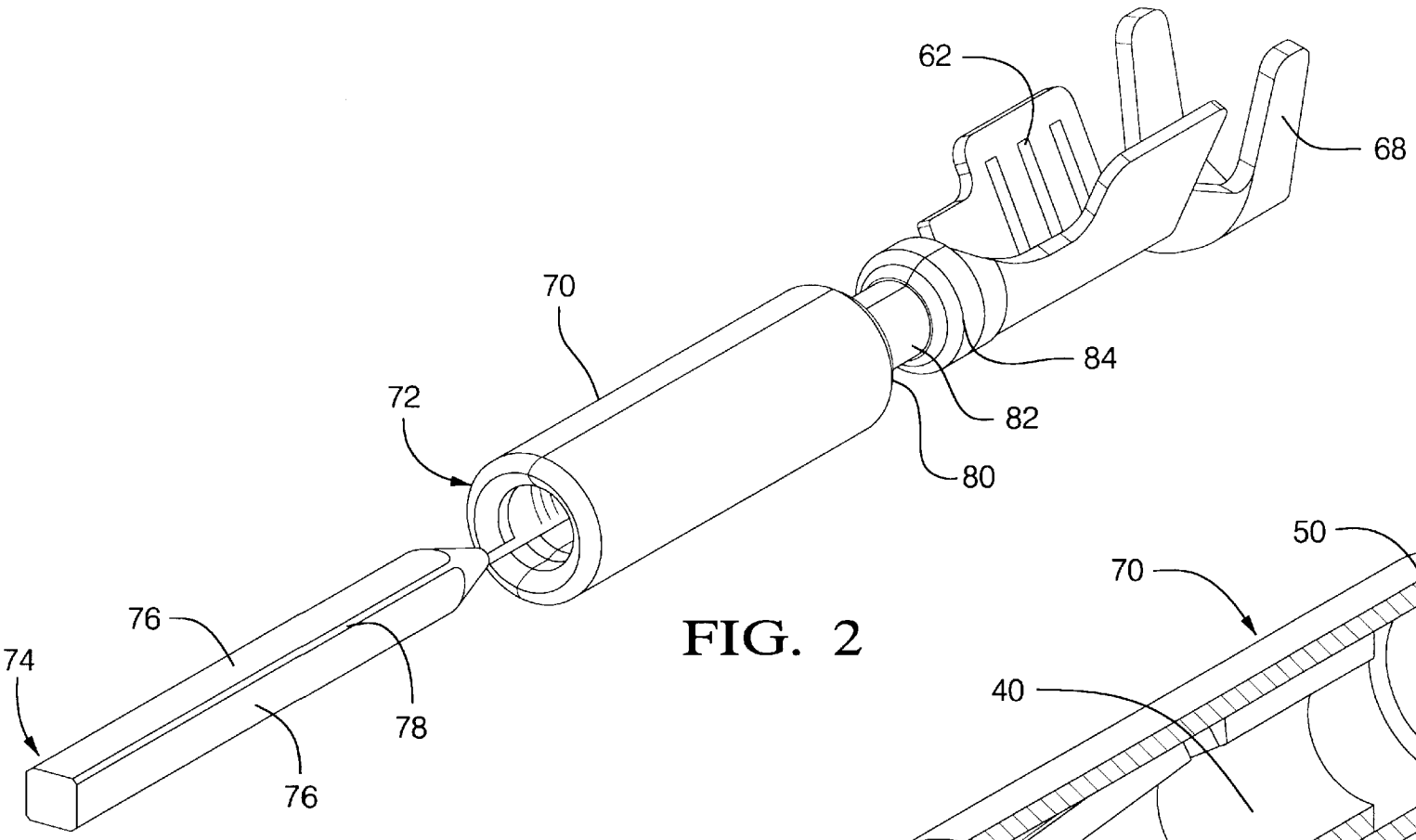
FIG. 2 illustrate a female and male terminal with chamfered corners according to the present invention.

Referring now to FIG. 2, a female electrical terminal according to the present invention includes a first outer barrel portion 70 of a first diameter with an opened end 72 for receiving a male pin 74. A necked down portion 80 is positioned at the other end of the outer barrel portion 70 for engagement with a nub on a flexible lock finger of a female terminal retainer as will be described hereafter. A second outer barrel portion 82 is attached to the necked down section 80 and has a diameter smaller than the first outer barrel portion 70. The raised feature 84 is adjacent the second barrel portion 82 to provide a locking shoulder for engagement with the nub of the flexible lock finger. As described earlier, wire crimped tabs 62 and insulation crimped wings 68 are provided at the tail of the female electrical terminal.

The male pin 74 may have a round configuration or a square type as shown in FIG. 2. Preferably the male pin 74 has adjacent sides 76 formed at substantially right angle to each other and includes a chamfered corner 78 therebetween.

Figure 3:
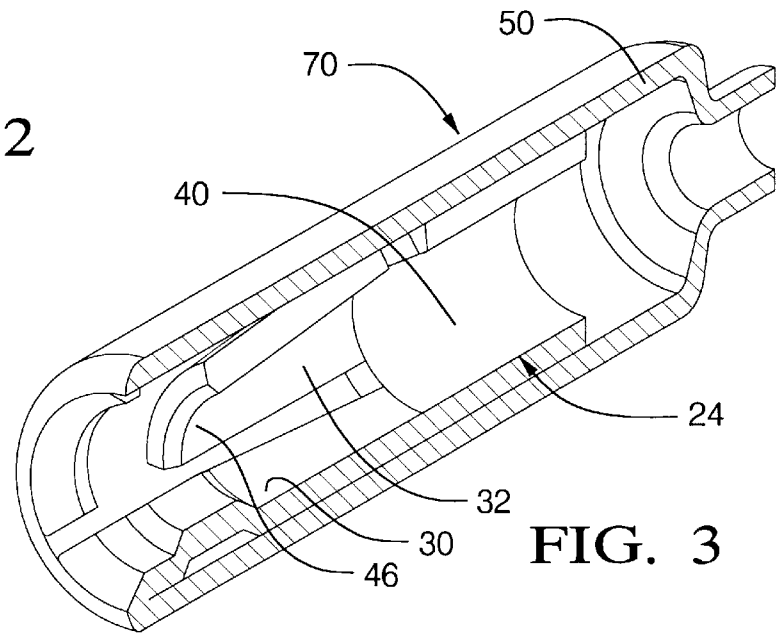
FIG. 3 is a sectional view of a female electrical terminal according to the present invention.

Referring now to FIG. 3, this sectional view illustrates the electrical contact portion 86 which includes the first electrical contact finger (not shown), the second end third electrical contact fingers 30, 32 and the bridge 40. The electrical contact fingers 28,30, and 32 are positioned at approximately 60 degrees with respect to each other. While the second electrical contact finger 30 is relatively stationary, the free ends of the first and third electrical contact fingers 28, 32 allow for substantial movement of the first and third electrical contact fingers 28,30.

Figure 4:
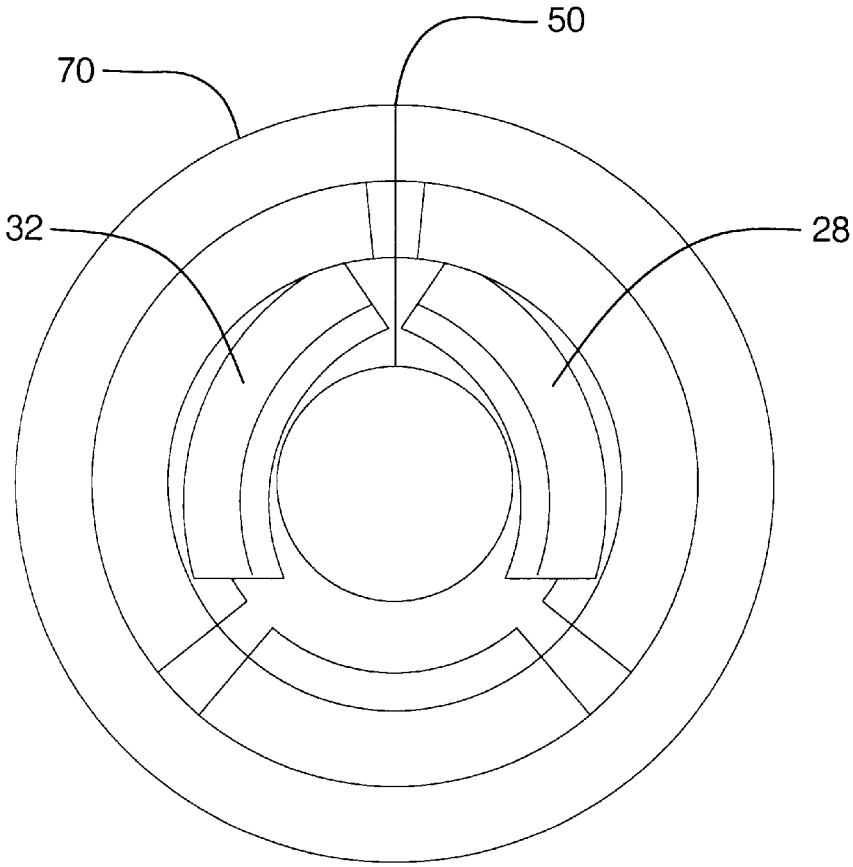
FIG. 4 is an end view of a female electrical terminal having an electrical contact portion including two flexible contact fingers and one relatively stationary contact finger according to the present invention.
Figure 5:
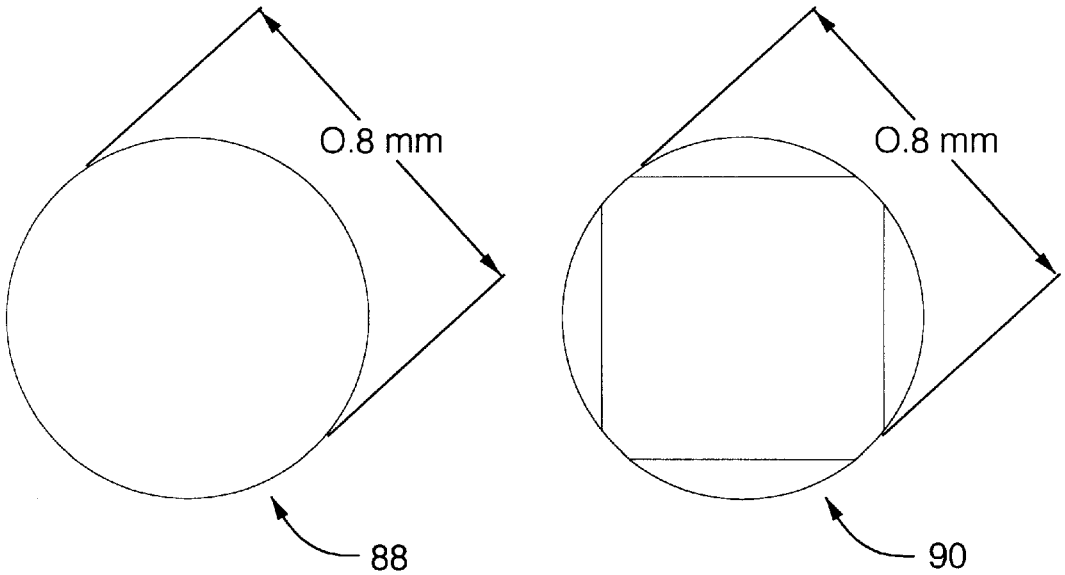
FIG. 5 depicts the similarity of the cross-section of a round and square pin with chamfered corners useful in the present invention.

Referring now to FIGS. 4–5, because the free ends 44, 46 of the first and third electrical contact fingers 28, 32 respectively are movable, the female electrical terminal can accept either a round pin 88 or a square type pin 90 having chamfered corners as depicted in FIG. 5.

What is claimed is:

1. An electrical connector system comprising an electrical female terminal having an electrical contact portion for making electrical contact with either a round or square type male pin, the electrical contact portion including first, second and third fingers, each having a first end connected to a bridge, the second finger having a second end connected to a first outer barrel portion of the electrical female terminal, the first and third fingers having second ends that are free, the electrical contact portion being enclosed by the first outer barrel portion and the first outer barrel portion having an open end to allow a male pin to be inserted therein and to make electrical contact with the first, second and third fingers of the electrical contact portion.

2. The electrical connector system as defined in claim 1 wherein the first, second and third fingers of the electrical contact portion all extend from the bridge in the same longitudinal direction.

3. The electrical connector system defined in claim 1 wherein the electrical female terminal is of one-piece construction.

4. An electrical connector system as set forth in claim 1 wherein the terminal is constructed and arranged to receive a square type male pin having chamfered corners.

5. An electrical system as se forth in claim 4 wherein the round pin has a diameter of about 0.8 mm and the square type pin has side of about 0.64 mm and about 0.8 mm between diagonally positioned chamfered corners.

6. An electrical connector system comprising an electrical female terminal of one piece construction, the electrical female terminal having an electrical contact portion for making electrical contact with either a round or square type male pin, the electrical contact portion including first, second and third fingers, each having a first end connected to a bridge of the electrical female terminal and extending from the bridge in the same longitudinal direction, the second finger having a second end connected to a first outer barrel portion of the electrical female terminal, the first and third fingers having second ends that are free, the electrical contact portion being enclosed by the first outer barrel portion, and the first outer barrel portion having an open end to allow a male pin to be inserted therein and to make electrical contact with the first, second and third fingers of the electrical contact portion.

* * * * *

United States Patent and Trademark Office
Certificate

Patent No. 6,086,434 Patented: July 11, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Marco Rollero, Turin, Italy; Robert Leroy Sten, Warren, Ohio; and Ward M. Judson, Streetsboro, Ohio.

Signed and Sealed this Twenty-eighth Day of March 2006.

PAULA BRADLEY
*Supervisory Patent Examiner*
Art Unit 2833